US008000484B2

(12) United States Patent
Rasmussen

(10) Patent No.: US 8,000,484 B2
(45) Date of Patent: Aug. 16, 2011

(54) SPEAKER SYSTEM FOR A GAMING MACHINE

(75) Inventor: James M. Rasmussen, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 120 days.

(21) Appl. No.: 11/569,732

(22) PCT Filed: May 26, 2005

(86) PCT No.: PCT/US2005/018595

§ 371 (c)(1),
(2), (4) Date: Dec. 19, 2007

(87) PCT Pub. No.: WO2005/120127

PCT Pub. Date: Dec. 15, 2005

(65) Prior Publication Data

US 2008/0211276 A1 Sep. 4, 2008

Related U.S. Application Data

(60) Provisional application No. 60/575,605, filed on May 28, 2004, provisional application No. 60/575,153, filed on May 28, 2004, provisional application No. 60/575,604, filed on May 28, 2004, provisional application No. 60/640,350, filed on Dec. 30, 2004.

(51) Int. Cl.
*H04R 5/02* (2006.01)
*H04R 1/02* (2006.01)
*A47C 7/72* (2006.01)

(52) U.S. Cl. ..... 381/301; 381/333; 381/388; 381/351; 297/217.4

(58) Field of Classification Search ..... 381/301, 381/332–335, 388, 87, 337, 345, 349, 351; 463/35, 46; 297/217.4; 181/182, 187, 189
See application file for complete search history.

(56) References Cited

U.S. PATENT DOCUMENTS 2,689,016 A * 9/1954 Lang ..... 181/145
4,413,198 A * 11/1983 Bost ..... 310/324
4,549,631 A * 10/1985 Bose ..... 181/155
4,705,274 A 11/1987 Lubeck
4,805,952 A 2/1989 Coleman
4,840,343 A 6/1989 Gasser
4,875,546 A * 10/1989 Krnan ..... 181/160
(Continued)

FOREIGN PATENT DOCUMENTS

JP 5031254 2/1993

OTHER PUBLICATIONS

"International Search Report for Application No. PCT/US2005/018595, date mailed Oct. 25, 2005", 3 pgs.

(Continued)

*Primary Examiner* — Xu Mei
(74) *Attorney, Agent, or Firm* — Schwegman, Lundberg & Woessner, P.A.

(57) ABSTRACT

A system includes a chair having an electrical connection to electrically connect the chair to a gaming device and a speaker package incorporated into the chair and coupled to the electrical connection. The speaker package includes a speaker mounted to a central member between a first shell defining a front cavity and a second shell defining a back cavity.

24 Claims, 12 Drawing Sheets

U.S. PATENT DOCUMENTS

| | | | | |
|---|---|---|---|---|
| 5,083,738 | A | 1/1992 | Infanti | |
| 5,102,192 | A | 4/1992 | Barile | |
| 5,114,112 | A | 5/1992 | Infanti | |
| 5,232,191 | A | 8/1993 | Infanti | |
| 5,290,034 | A | 3/1994 | Hineman | |
| 5,398,992 | A * | 3/1995 | Daniels | 297/217.4 |
| 5,409,296 | A | 4/1995 | Barile | |
| 5,437,453 | A | 8/1995 | Hineman | |
| 5,522,641 | A | 6/1996 | Infanti | |
| 5,542,748 | A | 8/1996 | Barile | |
| 5,618,178 | A | 4/1997 | Copperman et al. | |
| 5,669,818 | A | 9/1997 | Thorner et al. | |
| 5,678,886 | A | 10/1997 | Infanti | |
| 5,762,617 | A | 6/1998 | Infanti | |
| 5,791,731 | A | 8/1998 | Infanti | |
| 5,807,177 | A | 9/1998 | Takemoto et al. | |
| 6,075,868 | A * | 6/2000 | Goldfarb et al. | 381/388 |
| 6,089,663 | A | 7/2000 | Hill | |
| 6,135,562 | A | 10/2000 | Infanti | |
| 6,161,892 | A | 12/2000 | Chabanne et al. | |
| 6,227,614 | B1 | 5/2001 | Rubin | |
| 6,354,660 | B1 | 3/2002 | Friedrich | |
| 6,422,670 | B1 | 7/2002 | Hedrick et al. | |
| 6,422,941 | B1 | 7/2002 | Thorner et al. | |
| 6,430,297 | B1 * | 8/2002 | Nakamura | 381/345 |
| 6,530,842 | B1 | 3/2003 | Wells et al. | |
| 6,572,187 | B2 | 6/2003 | Laufer | |
| 7,112,139 | B2 | 9/2006 | Paz et al. | |
| 7,136,498 | B1 * | 11/2006 | Schott | 381/351 |
| 7,364,508 | B2 | 4/2008 | Loose et al. | |
| 7,367,886 | B2 * | 5/2008 | Loose et al. | 463/35 |
| 7,479,063 | B2 | 1/2009 | Pryzby et al. | |
| 7,688,992 | B2 * | 3/2010 | Aylward et al. | 381/388 |
| 7,766,747 | B2 | 8/2010 | Bonney et al. | |
| 7,826,627 | B2 | 11/2010 | Radek | |
| 7,867,085 | B2 | 1/2011 | Pryzby et al. | |
| 2002/0041069 | A1 | 4/2002 | Steelman | |
| 2002/0155887 | A1 | 10/2002 | Criss-Puszkiewiez et al. | |
| 2003/0122973 | A1 | 7/2003 | Huang | |
| 2004/0142747 | A1 | 7/2004 | Pryzby | |
| 2004/0161115 | A1 | 8/2004 | Loose | |
| 2004/0162144 | A1 | 8/2004 | Loose et al. | |
| 2004/0254020 | A1 | 12/2004 | Dragusin | |
| 2004/0258270 | A1 | 12/2004 | Shima | |
| 2005/0053252 | A1 | 3/2005 | Cohen | |
| 2005/0054442 | A1 | 3/2005 | Anderson et al. | |
| 2005/0159219 | A1 | 7/2005 | Oswald | |
| 2006/0068908 | A1 | 3/2006 | Pryzby et al. | |
| 2006/0068909 | A1 | 3/2006 | Pryzby et al. | |
| 2006/0073881 | A1 | 4/2006 | Pryzby et al. | |
| 2006/0100015 | A1 | 5/2006 | Loose et al. | |
| 2007/0015570 | A1 | 1/2007 | Pryzby | |
| 2007/0270216 | A1 | 11/2007 | Pryzby | |
| 2007/0293304 | A1 | 12/2007 | Loose et al. | |
| 2008/0009347 | A1 | 1/2008 | Radek | |
| 2008/0039215 | A1 | 2/2008 | Hahn | |
| 2008/0054561 | A1 | 3/2008 | Canterbury et al. | |
| 2008/0064486 | A1 | 3/2008 | Pryzby et al. | |
| 2008/0070685 | A1 | 3/2008 | Pryzby et al. | |
| 2008/0096666 | A1 | 4/2008 | Pryzby et al. | |
| 2008/0111408 | A1 * | 5/2008 | Duran et al. | 297/217.4 |
| 2008/0139284 | A1 | 6/2008 | Pryzby et al. | |
| 2008/0161108 | A1 | 7/2008 | Dahl et al. | |
| 2008/0176654 | A1 | 7/2008 | Loose et al. | |
| 2008/0188291 | A1 | 8/2008 | Bonney et al. | |
| 2008/0194319 | A1 | 8/2008 | Pryzby et al. | |
| 2008/0214289 | A1 | 9/2008 | Pryzby et al. | |
| 2008/0234026 | A1 | 9/2008 | Radek | |
| 2008/0246321 | A1 | 10/2008 | Canterbury | |
| 2009/0170597 | A1 | 7/2009 | Bone | |
| 2009/0298579 | A1 | 12/2009 | Radek et al. | |
| 2010/0029385 | A1 | 2/2010 | Garvey et al. | |
| 2010/0075750 | A1 | 3/2010 | Bleich | |
| 2010/0248815 | A1 | 9/2010 | Radek | |
| 2010/0298051 | A1 | 11/2010 | Loose et al. | |
| 2010/0317437 | A1 | 12/2010 | Berry et al. | |

OTHER PUBLICATIONS

"Written Opinion of the International Searching Authority for Application No. PCT/US2005/018595, date mailed Oct. 25, 2005", 7 pgs.
"U.S. Appl. No. 11/569,687, Response filed May 27, 2010 to Non Final Office Action mailed Jan. 27, 2010", 14 pgs.
"U.S. Appl. No. 11/569,689, Final Office Action mailed Sep. 14, 2009", 18 pgs.
"U.S. Appl. No. 11/569,689, Non-Final Office Action mailed Jan. 13, 2009", 16 pgs.
"U.S. Appl. No. 11/569,689, Preliminary Amendment filed Nov. 28, 2006", 3 pgs.
"U.S. Appl. No. 11/569,689, Response filed Jul. 10, 2009 to Non Final Office Action mailed Jan. 13, 2009", 11 pgs.
"U.S. Appl. No. 11/569,687 Non-Final Office Action mailed Jan. 27, 2010", 11 pgs.
"U.S. Appl. No. 11/569,687, Advisory Action mailed Dec. 21, 2010", 3 pgs.
"U.S. Appl. No. 11/569,687, Final Office Action mailed Aug. 20, 2010", 10 pgs.
"U.S. Appl. No. 11/569,689, Amendment and Response filed Aug. 16, 2010 to Final Office Action mailed Sep. 14, 2009", 22 pgs.
"U.S. Appl. No. 11/569,730, Response filed Jan. 13, 2011 to Non Final Office Action mailed Oct. 13, 2010", 14 pgs.
"International Application Serial No. PCT/US05/18475, International Search Report mailed Oct. 21, 2005", 4 pgs.
"International Application Serial No. PCT/US05/18475, Written Opinion mailed Oct. 21, 2005", 6pgs.
"International Application Serial No. PCT/US05/18681, International Search Report mailed Oct. 24, 2005", 3 pgs.
"International Application Serial No. PCT/US05/18681, Written Opinion mailed Oct. 24, 2005", 5 pgs.
"U.S. Appl. No. 11/569,687, Preliminary Amendment filed Nov. 28, 2006", 3 pgs.
"U.S. Appl. No. 11/569,687, Response filed Nov. 22, 2010 to Final Office Action mailed Aug. 20, 2010", 16 pgs.
"U.S. Appl. No. 11/569,730, Non-Final Office Action mailed Oct. 13, 2010", 14 pgs.
"U.S. Appl. No. 11/569,687 Final Office Action mailed Aug. 20, 2010", 10 pgs.
"International Application Serial No. PCT/US05/18595, International Search Report mailed Oct. 25, 2005", 2 pgs.
"International Application Serial No. PCT/US05/18595, Written Opinion mailed Oct. 25, 2005", 6 pgs.

* cited by examiner

SPEAKER SYSTEM FOR A GAMING MACHINE

CROSS-REFERENCE TO RELATED APPLICATION

This application is a U.S. National Stage Filing under 35 U.S.C. 371 from International Patent Application Serial No. PCT/US2005/018595, filed May 26, 2005, and published on Dec. 15, 2005 as WO 2005/120127 A1, which claims the benefit under 35 U.S.C. 119 (e) of U.S. Provisional Application No. 60/575,604 filed on May 28, 2004, which applications are hereby incorporated by reference in their entirety. This application is related to U.S. Provisional Patent Application Ser. No. 60/575,605, entitled "CHAIR INTERCONNECTION FOR A GAMING MACHINE" and is also related to U.S. Provisional Patent Application Ser. No. 60/575,153, entitled "GAMING DEVICE WITH ATTACHED AUDIO-CAPABLE CHAIR" both filed on May 28, 2004, and is also related to U.S. Provisional Patent Application Ser. No. 60/640,350, entitled "CHAIR INTERCONNECTION FOR A GAMING MACHINE" filed Dec. 30, 2004, all of which are hereby incorporated by reference herein for all purposes.

FIELD

The invention relates generally to speaker systems, and more specifically to a speaker system for gaming systems.

COPYRIGHT

A portion of the disclosure of this patent document may contain material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2005, WMS Gaming, Inc. All Rights Reserved.

BACKGROUND

A wide variety of gaming devices are now available to game players and to gaming establishment operators in computerized form, from slot machines to games that are traditionally played live such as poker and blackjack. Computerized video game systems are designed to provide sufficient feedback to the gamer to make the game fun to play, and provide a gaming experience that is at least as attractive as the older mechanical gaming machine experience to the gamer, to ensure success in a competitive gaming market.

Many computer elements have been employed in gaming systems, from computerized animation to playing prerecorded sounds through a gaming system's speakers. These are designed to attract the attention of gamers and to provide a memorable gaming experience. For example, the sounds are loaded within the computerized gaming machine and played through speakers to supplement the wagering game experience, much as is done with personal computer games and television-based video games.

SUMMARY

In one aspect a system includes a chair having an electrical connection to connect the chair to a gaming device and a speaker package incorporated into the chair and coupled to the electrical connection. The speaker package includes a speaker mounted to a central member and located between a first shell defining a front cavity and a second shell defining a back cavity.

One aspect provides a system including a chair and a discrete speaker package mounted to a back frame of the chair and filling at least a portion of a chair back.

In one aspect a system includes a chair having a speaker incorporated into the chair, and a base. The chair is coupled to the base and an electrical connection from the speaker runs through the base. The base includes a front end including a mechanical connection and an electrical connection to removably connect the base to a gaming device such that sound signals can be delivered to the speaker.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the invention. The following detailed description is, therefore, not to be taken in a limiting sense, and the scope of the invention is defined by the appended claims and their equivalents.

As used herein, the term "gaming machine" refers to a machine into which a coin or token is deposited, or which is activated by a card or token associated with data regarding non-monetary chattel, to play a game that uses a video display or an electromechanical device with a spinning reel. The gaming machines include slot machines and push button machines. The gaming machines include coin operated machines and machines having a serial interface. Gaming machines also include gaming tables capable of being initiated by a card or token.

Figure 1:
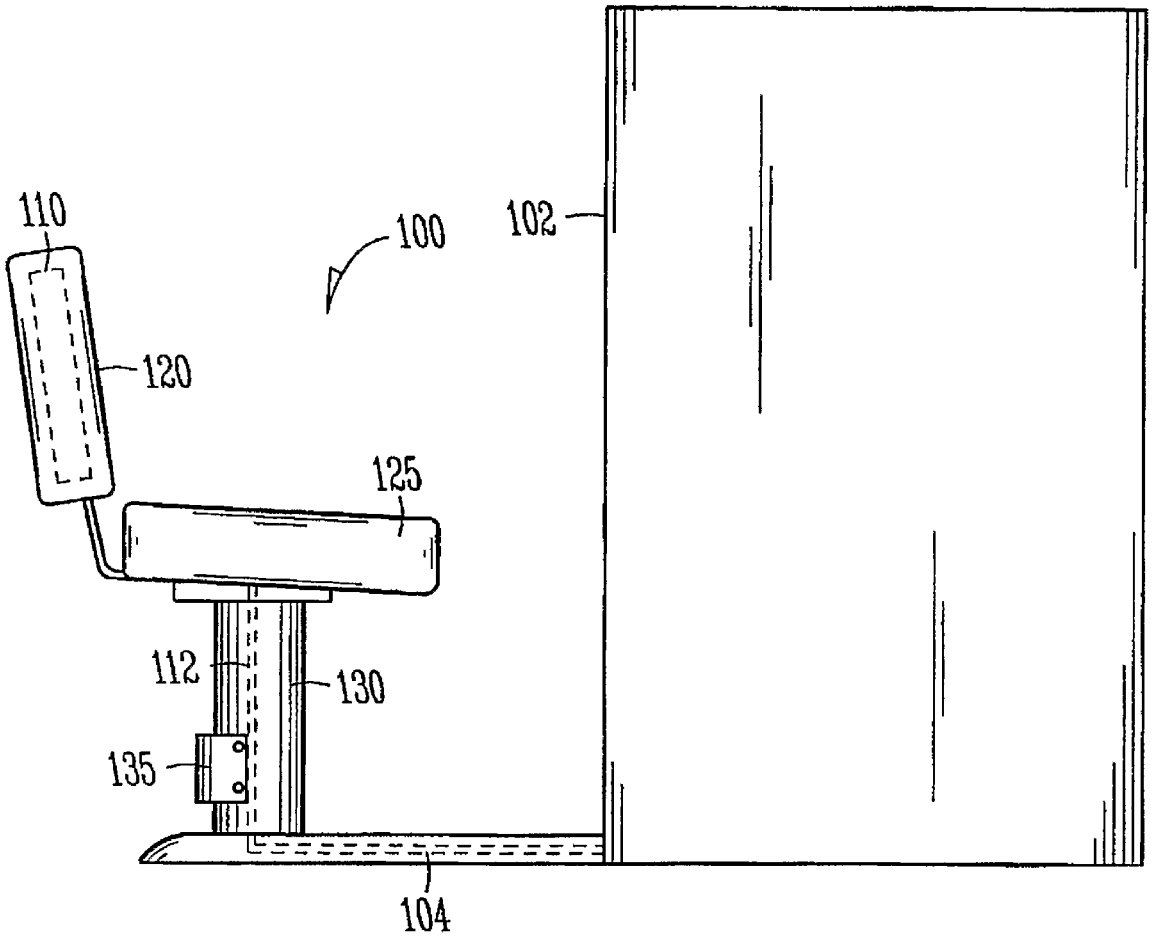
FIG. 1 shows the general environment for an audio chair according to one embodiment.

FIG. 1 shows the general environment for an audio chair 100 according to one embodiment. In this example, the system includes chair 100 electrically and mechanically coupled to a gaming device 102. Gaming device 102 can be a gaming machine such as a slot machine, for example. In one embodiment, chair 100 is coupled to the gaming machine via a sled or base 104.

The system further includes a speaker package 110 incorporated into chair 100 and coupled via an electrical connection to gaming device 102. Gaming device 102 includes hardware and software and produces sound signals which are delivered to speaker package 110. Speaker package 110 provides sound effects, game noises, and other audio effects from gaming device 102. In one example, an electrical connection 112 runs through base 104 from device 102 to speaker package 110 in the chair.

Chair 100 generally includes a seat back 120 and a seat 125. The chair is swivel mounted to a seat post 130. Seat post 130 is at least partially hollow to allow connection 112 to run through the post. In one embodiment, an access panel 135 is provided in the seat post 130 to allow access to connection 112 to allow a user to connect wires running from speaker package 110 to a circuit board connection in base 104.

Figure 2:
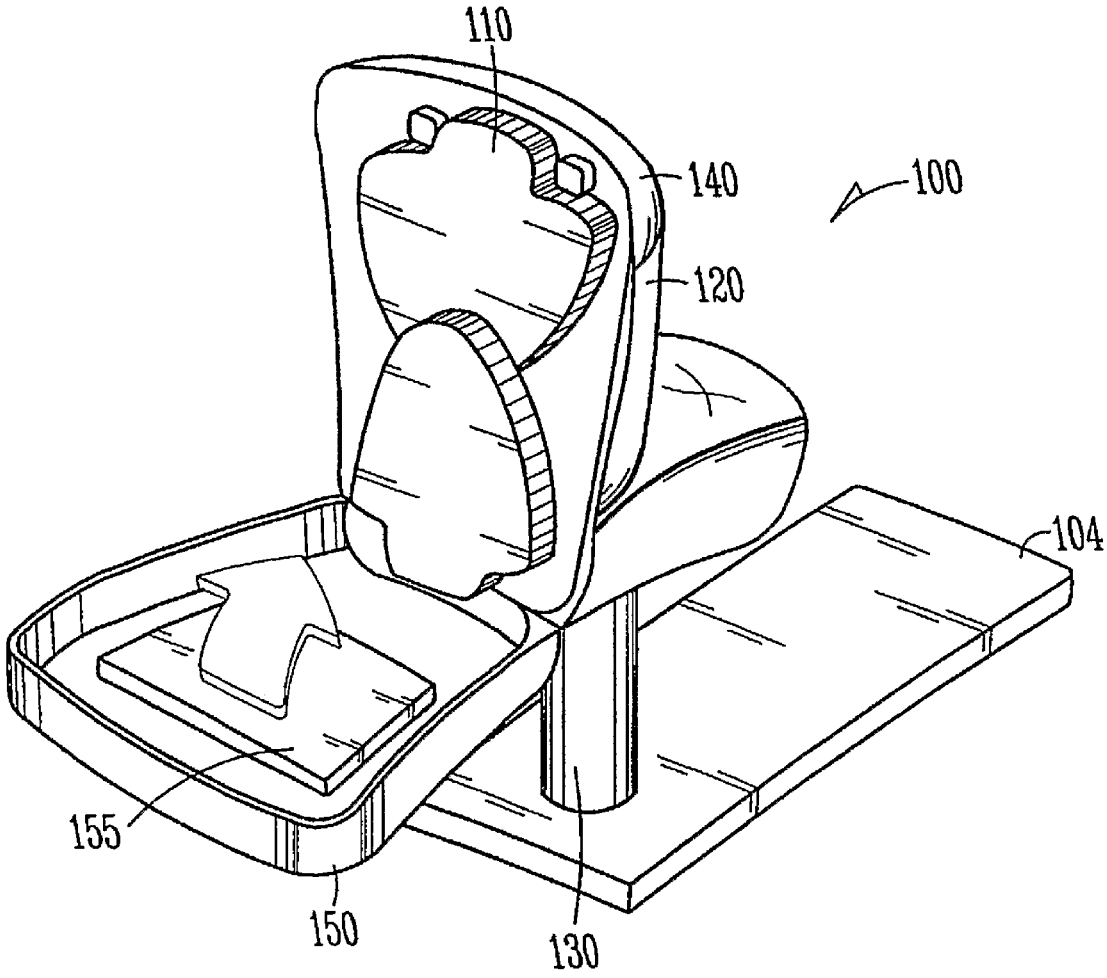
FIG. 2 shows a back perspective view of a chair, in accordance with one embodiment.

FIG. 2 shows a back perspective view of chair 100, in accordance with one embodiment. The back 120 of chair 100 includes a front portion 140 and a back portion 150. Speaker package 110 is mounted within seat back 120 between front portion 140 and back portion 150. In one example, back portion 150 is hingedly or removably connected to the chair, allowing access to speaker package 110. In one embodiment, a display device 155, such as an LCD or lit glass screen, or other type of screen or electronic signage is mounted to chair 100 and mounted so as to be exposed on an outer surface of the chair. Again, the hinged or removable back 150 allows access to the display device 155. Advertisements, game previews, or other information can be shown on display device 155. Display device 155 can be electrically connected to game device 102 (FIG. 1) via an electrical connection, as will be further explained below.

Figure 3:
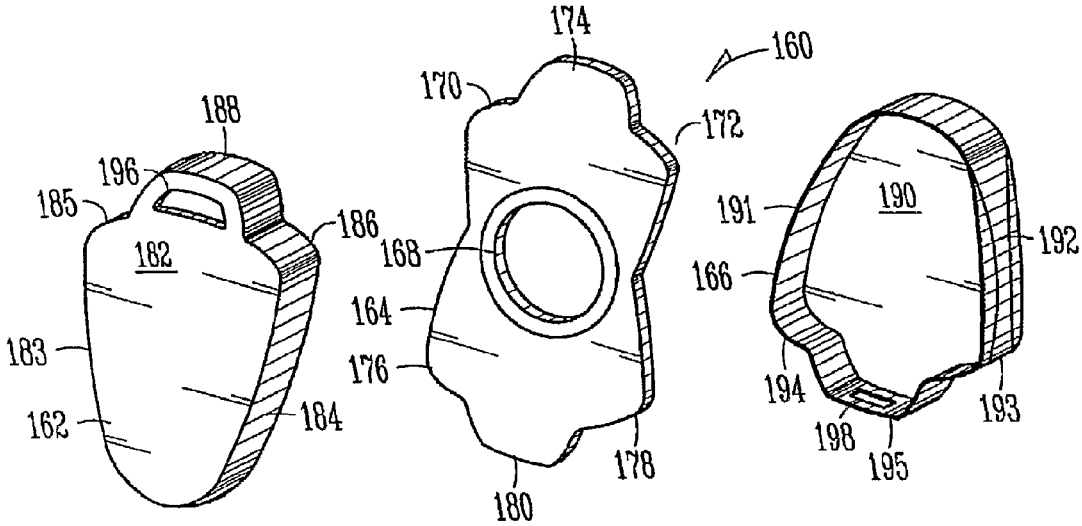
FIG. 3 shows an exploded view of a speaker package, in accordance with one embodiment.
Figure 4:
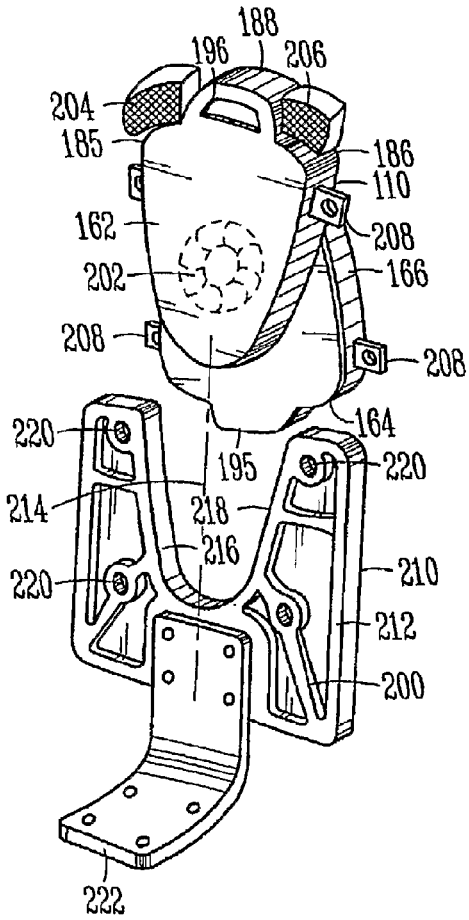
FIG. 4 shows a speaker package as assembled, in accordance with one embodiment.

FIG. 3 shows an exploded view of a shell assembly 160 for speaker package 110 (FIG. 2), in accordance with one embodiment. FIG. 4 shows speaker package 110 as assembled. Shell assembly 160 includes a front shell or member 162, a central member 164 and a back shell or member 166. Central member 164 is a generally planar member and includes a mounting area, such as a hole 168 for mounting a speaker to the central member. In this example, central member 164 includes a pair of upper shoulders or wings 170 and 172 and an upper projection 174. Symmetrically opposed to these are a lower pair of wings 176 and 178 and a lower projection 180. Front member 162 is shaped and dimensioned to fill the seat back. Accordingly, front member 162 includes a generally planar front surface 182, a pair of outwardly and upwardly sloping side walls 183 and 184, a pair of upper shoulders 185 and 186, and an upper projection 188. On its back side (not shown), front member 162 includes a hollow or cavity area such that the front member is a shell that when the front member is mounted over central member 164, there is a cavity or space defined by side walls 183, 184 and between front surface 182 and central member 164.

Back member 166 is a substantially similar structure and shape relative to front member 162. Back member 166 includes a back wall surface 190, a pair of outwardly and downwardly sloping walls 191 and 192, a pair of lower shoulders or wings 193 and 194 and a lower projection 195. Back member 166 and front member 162 are substantially mirror images of each other.

The front member and back member mount in opposite manner to central member 164. In other words, they are mounted upside down relative to each other. In one embodiment, the front member shoulders 185, 186 align with upper wings 170 and 172 of central member 164, while the lower shoulders 194, 195 of back member 166 align with lower wings 176, 178 of the central member. The front and rear spaces or cavities defined by the front and back members and central member 164 are substantially similar in size. This optimizes the performance of the speaker mounted between the spaces.

Referring to FIG. 4, assembled speaker package 110 includes speakers 202, 204, and 206, in accordance with one embodiment. Central member 164 is sandwiched between front member 162 and back member 166. Speaker 202, which can be a transducer, subwoofer or other speaker type, is mounted to central member 164. Front member 162 includes a port 196 in an upper portion of the front member, for example within upper projection 188. Port 196 allows air and sound to pass through to the person seated in the chair. Back member 166 includes a port 198. Port 198 corresponds to port 196 and equalizes the air pressure of each side of the speaker assembly. Port 198 can be located in the lower projection 195 of the back member or in other locations.

Mounted to shoulders 185 and 186 respectively, are speakers 204 and 206. In one embodiment, speaker assembly 110 includes one or more mounting members 208 to mount the speaker assembly to a chair back mount 210. Chair back mount 210 includes a back mounting frame 212 including a U-shaped cut-out 214. Cut-out 214 is defined by a pair of upwardly and outwardly sloping side walls 216 and 218 that correspond to side walls 183 and 184 of the speaker assembly. Thus, the corresponding U-shape of the speaker assembly fits within the U-shaped cut-out of the chair back mount and is mounted using screws or other fasteners through mounting members 208 into corresponding mounting members 220 on the chair back. Chair back 212 can also be coupled to a rear angle 222 to mount the chair back to the seat or seat post of the chair.

Thus, in one embodiment, speaker package 110 is a discrete unit, which can be pre-assembled and pre-tested before mounting to the chair mount. This allows the speaker package to be optimized for sound performance instead of just being retrofit into a typical chair. Moreover, speaker package 110 front member 162 is shaped and has a form factor so as to fill at least a part of the chair back, thus storing the speakers within the chair back in a way so as to allow for optimal performance in a tight space. Again, this discrete speaker packaging system allows for improved sound from the speaker assembly since the speaker is properly mounted to central member 164 between the pair of front and back shells 162, 166 and thus defining similarly sized air spaces and is mounted in a manner such as to fill a part of the chair itself. Thus, speaker package 110 is integrated into the actual structure of the chair and not merely an add-on feature.

Figure 5:
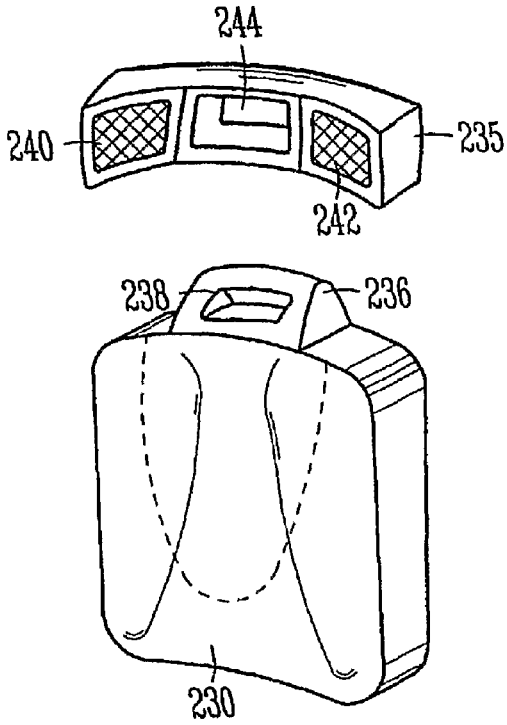
FIG. 5 shows a perspective view of a front portion of a chair back and a speaker cap, in accordance with one embodiment.

FIG. 5 shows a perspective view of a front part 230 of a chair back and a speaker cap 235, in accordance with one embodiment. Front part 230 can include a contoured molded foam structure shaped to cover over speaker assembly 110 (FIG. 4). An upper projection 236 includes an opening 238 corresponding to the port 196 in the speaker assembly (FIG. 4). Speaker cap 235 includes a pair of grilles 240 and 242 and a central opening or grille 244. Grilles 240, 242 cover speakers 204, 206 (FIG. 4), while opening or grille 244 communicates with opening 238 and port 196.

Figure 6:
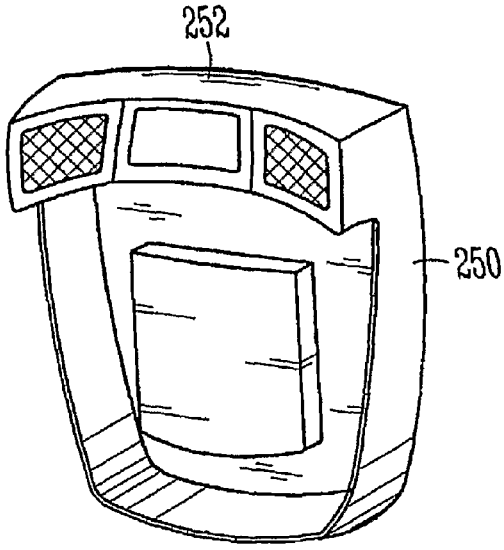
FIG. 6 shows a perspective view of a rear portion of a chair back and an integrated speaker cap, according to one embodiment.

FIG. 6 shows a perspective view of a chair back 250, according to one embodiment. In this example, chair back 250 is mountable over the back of the speaker assembly 110 (FIG. 4) and an integral speaker cap 252 is placed over speakers 204, 206 and port 196.

Figure 7:
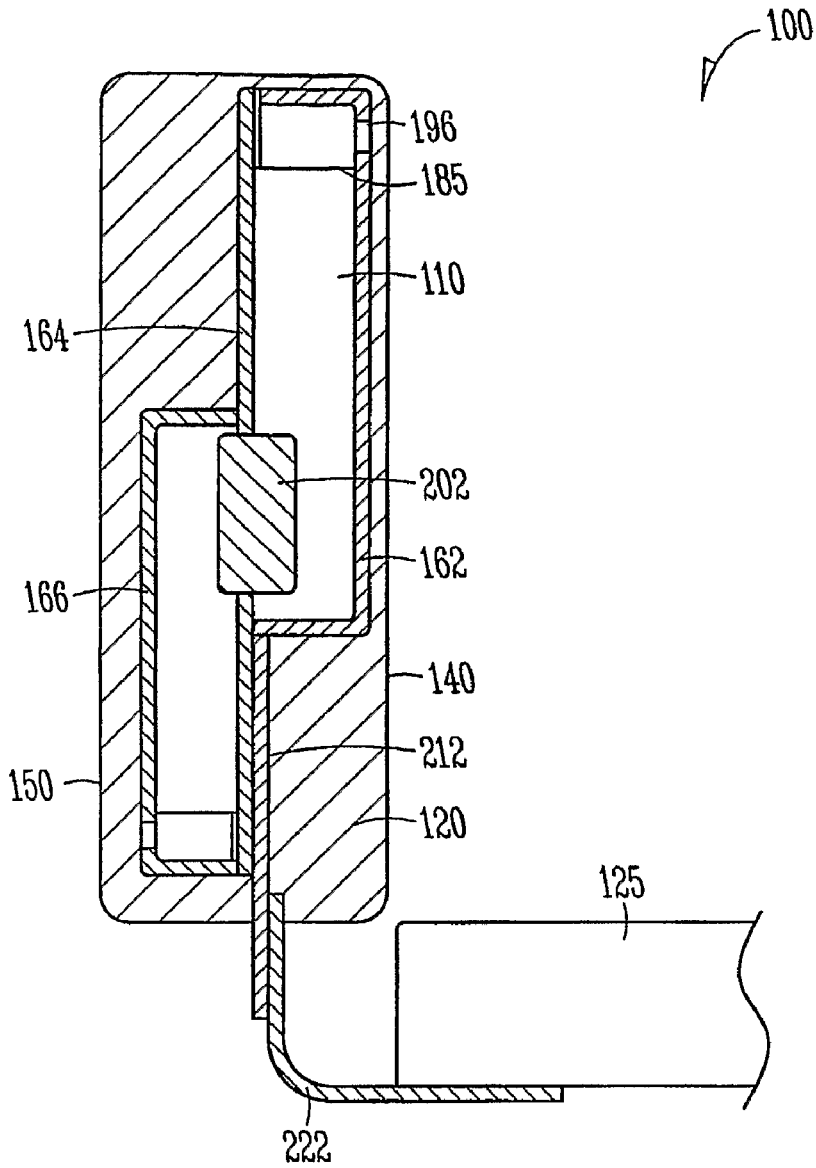
FIG. 7 shows a side view of a schematic representation of a portion of a chair, in assembled form, in accordance with one embodiment.

FIG. 7 shows a cross-section side view of a schematic representation of a portion of chair 100, in assembled form, in accordance with one embodiment. Again, seat 100 includes seat 125 and seat back 120. Mounting angle 222 connects the seat to back mounting frame 212. Speaker assembly 110 is mounted to mounting frame 212 such that front member 162 is towards the front of the chair and back member 166 is towards the back of the chair back. Central member 164 connects the front and back members together and seat back 150 and seat front 140 enclose the chair back and speaker assembly. As discussed previously, a grille cap can be mounted over the speakers as well. Speaker 202 is located and mounted to central member 164 so as to be about midway up the chair back with sound delivered thorough port 196. An upper speaker is mounted on shoulder 185 and is positioned so to be at about shoulder level of a seated user, or slightly above shoulder level, and angled slightly upward toward the ear of the user.

Figure 8:
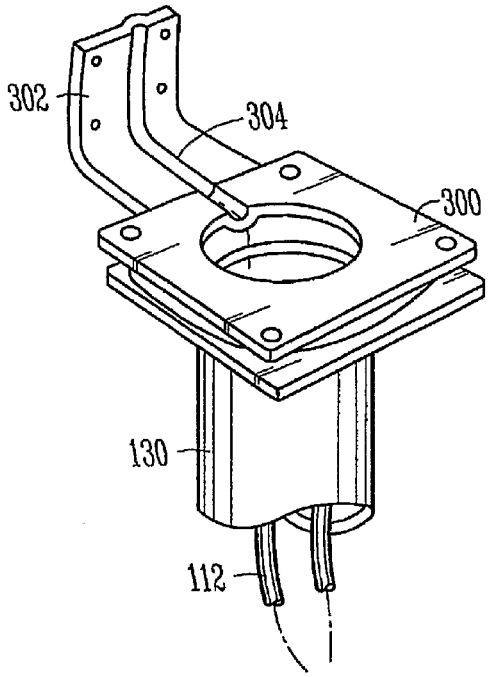
FIG. 8 shows an example of a swivel mount for a chair, in accordance with one embodiment.

FIG. 8 shows an example of a swivel mount 300 for a chair, in accordance with one embodiment. Swivel mount 300 mounts seat 125 (FIG. 1) to seat post 130. Electrical connection 112 extends up through seat post 130, through swivel mount 300 and along angle 302 into the chair back to deliver signals to the speaker assembly, as discussed above. In one embodiment, a groove 304 can be incorporated into the swivel mount to guide the electrical connection 112.

Figure 9:
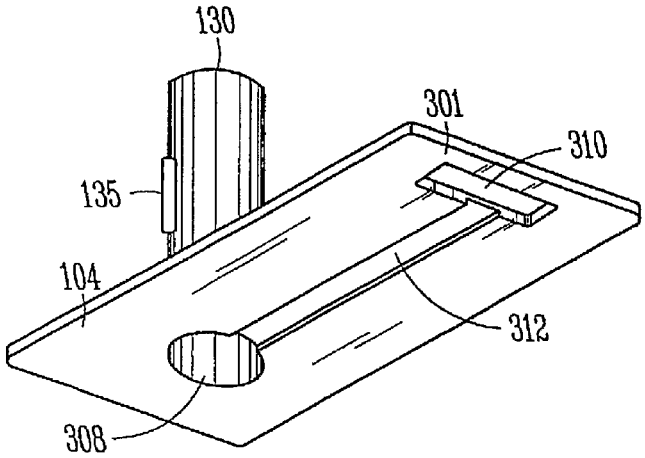
FIG. 9 shows a bottom, perspective view of a chair base, according to one embodiment.

FIG. 9 shows a bottom, perspective view of sled or base 104, according to one embodiment. Seat post 130 is mounted towards one end of base 104 and a front end 301 of the base is adapted to be mounted to a gaming machine, as will be discussed below. The bottom of base 104 includes a channel 312 having post opening 308 on one end and a connection opening 310 on a second end.

Figure 10:
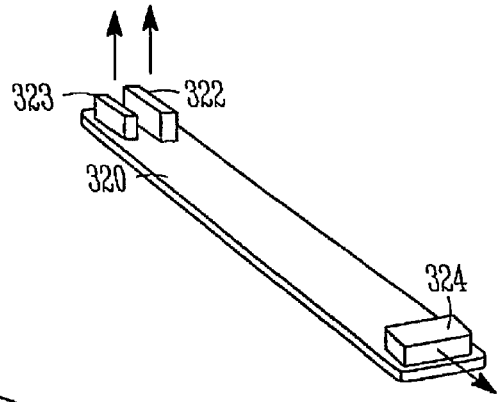
FIG. 10 shows a circuit board for a chair base, in accordance with one embodiment.

Referring to FIG. 10, a circuit board 320 is mountable within channel 312 of the base. The circuit board includes one or more connectors 322, 323 at one end for electrically connecting the circuit board to electrical connection 112 of the chair (FIG. 1). The circuit board also includes a connector 324 on a second end for electrically connecting the board to the gaming machine. Board 320 fits within channel 312 such that connectors 322, 323 are exposed through post opening 308 and connector 324 is exposed through opening 310 of the base. As discussed above, access panel 135 on chair post 130 can be opened to connect the wires from the chair to connectors 322, 323. In one embodiment, connector 322 delivers signals from the gaming machine to the speaker assembly in the chair while connector 232 is an auxiliary connector for lighting, video, etc.

Figure 11:
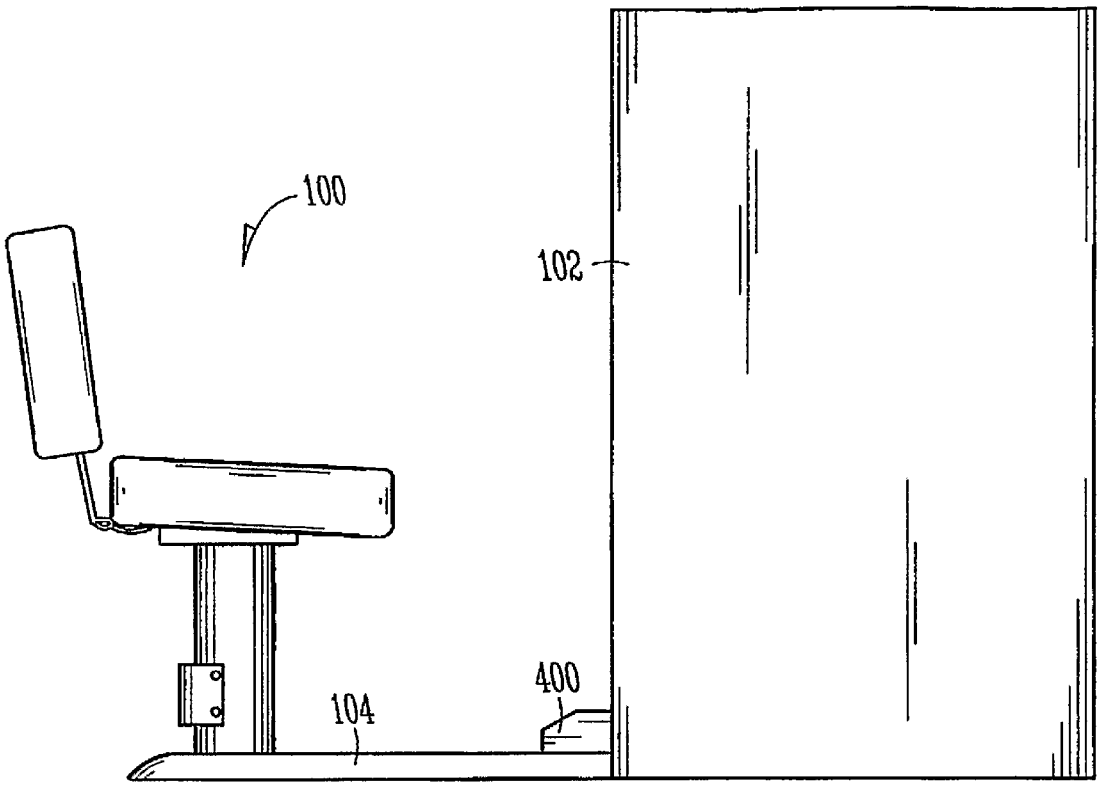
FIG. 11 shows a side view of a chair connected to a gaming device 102, in accordance with one embodiment.

FIG. 11 shows a side view of chair 100 connected to gaming device 102 via base 104, in accordance with one embodiment. In this example, base 104 is coupled near a front of the gaming device, and a shroud 400 is movably coupled to the base to allow access to connectors 324 (FIG. 10) and the corresponding connection on the game device. Shroud 400 protects the connection from spills or other damage. Referring to FIG. 1, an alternative connection between base 104 and gaming device is shown. In this example, the connectors 324 are under or within gaming device 102, thus protecting the connection.

Base 104 is removably connectable to gaming device 102, both mechanically and electrically. This allows for easier installation and maintenance than a permanent connection.

Figure 12:
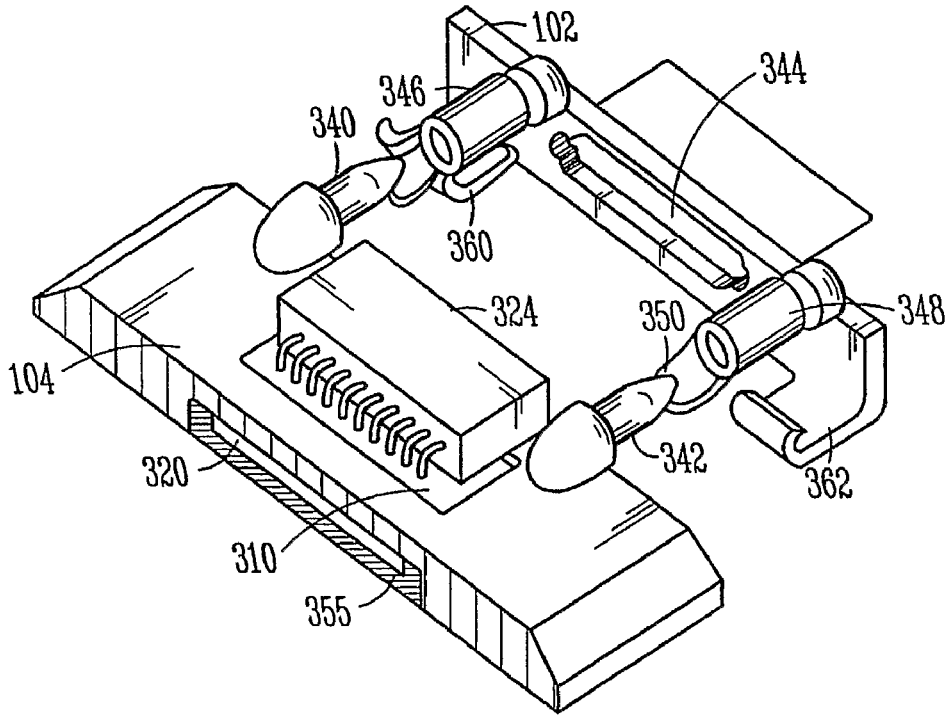
FIG. 12 shows an example of a mechanical and electrical connection between a base and a gaming device, in accordance with one embodiment.

FIG. 12 shows an example of a mechanical and electrical connection between base 104 and device 102. Base 104 is shown in cross-section, with circuit board 320 beneath the base and held in place by holding member 355. A connector 324 is attached to circuit board 320 via opening 310 in the base. In this example, one or more pins 340, 342 are attached to the front end of base 104 and extend over the front end of the base. At a lower front surface of device 102 are corresponding mating electrical connector 344 for connecting to connector 324 and sockets 346 and 348 for receiving pins 340, 342. The pin and socket mechanism is a guiding mechanism to help guide base 104 correctly into device 102 to ensure an appropriate electrical connection between connectors 324 and 344. The pin and socket system provides a positive guidance for providing base and device registration. Sockets 346 and 348 can include a guiding section, such as a flange 350 on a portion of the socket to help guide the pin toward the socket. The pins and sockets are dimensioned such that the pins are stopped before the connectors 324 and 344 can be damaged by too much force. In some embodiments, the pins can be located on the device 102 and the sockets can be located on the base 104. In one embodiment, gaming device 102 includes a latching member 360, 362 to mechanically latch the base to the device, as will be discussed below.

Figure 13:
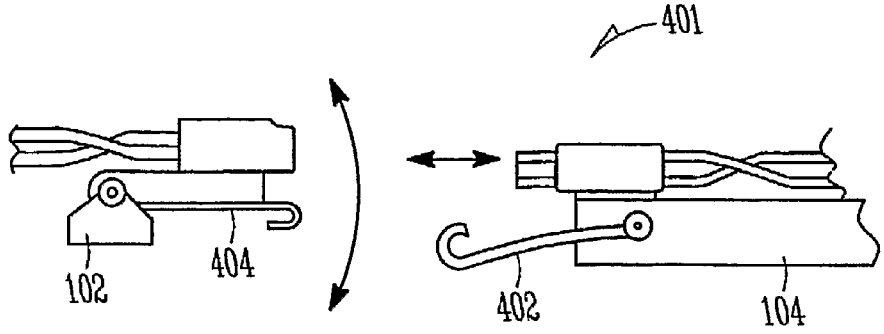
FIG. 13 shows a side view of a base and gaming device latching mechanism, in accordance with one embodiment.

FIG. 13 shows a side view of a base/device latching mechanism 401, in accordance with one embodiment. For example, latching mechanism 401 can include opposing latch bars 402 and 404 on either the base 104 or device 102 to positively latch the devices together. Latch member 404 can be rotatable to allow the latch members 404 and 402 to mate and latch together. This allows for variance in the floor height and also directs forces to the structural items and not to the electrical connection between the base and the gaming device.

Figure 14:
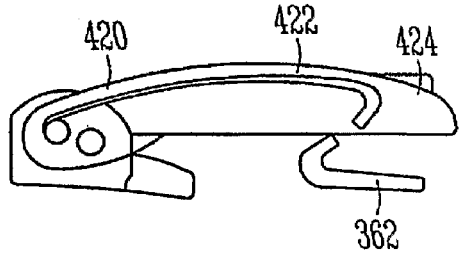
FIG. 14 shows a latch mechanism, in accordance with one embodiment.
Figure 15:
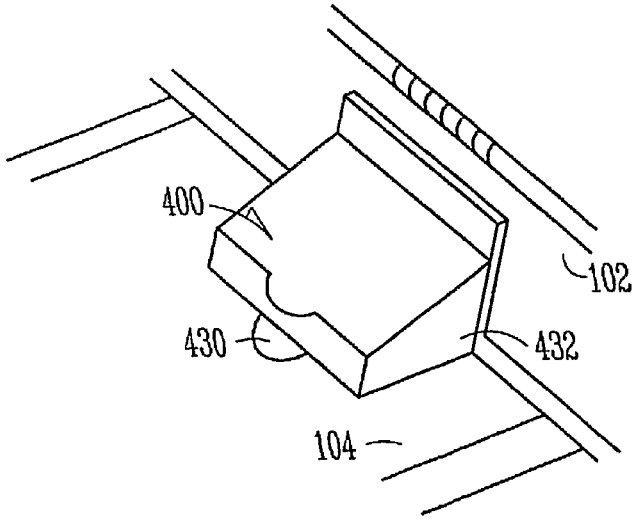
FIG. 15 shows a shroud for a base with an integrated latching mechanism, in accordance with one embodiment.

FIG. 14 shows another latch mechanism 420, in accordance with one embodiment. In this example, latch member 362 is attached to device 102 (FIG. 12) and latch member 422 is coupled to base 104 (FIG. 12). A handle 424 is provided to tighten or open the latch. Latch mechanism 420 can be an over-the-center latch. Referring to FIG. 15, in one example, handle 424 can be incorporated into shroud 400, and the shroud itself can act as the unlatching/latching actuator. For example, shroud 400 can be hinged to base 104 at the base edge 432 of the shroud. A hand cavity 430 is located at the junction of the shroud and the base to allow a user to grip the front of the shroud and pull up, rotating the shroud relative to the base. This will loosen latch member 422 from latch member 362 (FIG. 14). A reverse procedure latches the members together. Such a design provides for a non-tool technique for latching and unlatching the base 104 to the gaming device 102. It further is a non-obvious technique. This prevents unauthorized people from opening the latch.

Figure 16:
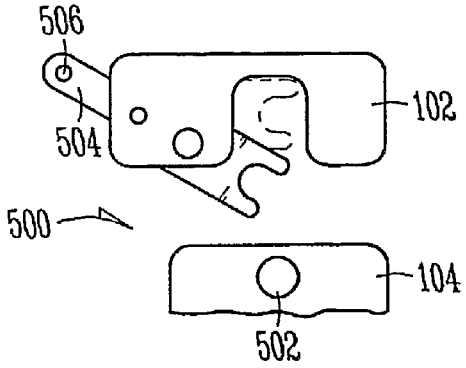
FIG. 16 shows a latch mechanism in accordance with one embodiment.

FIG. 16 shows a latch mechanism 500 in accordance with one embodiment. Latch mechanism includes a pin-and-clevis mechanism with a pin 502 coupled to base 104 and a clevis rotatably coupled to gaming device 102. Base 104 is inserted into device 102 such that pin 502 rotates clevis 504 to lock the pin into the device 102. To open the latch 500, a handle 506 is rotated counterclockwise. Again, this provides a tool-less, non-obvious techniques for removably mounting the base to the gaming device. In some examples, the pin can be located on device 102 and the clevis can be on base 104.

Figure 17:
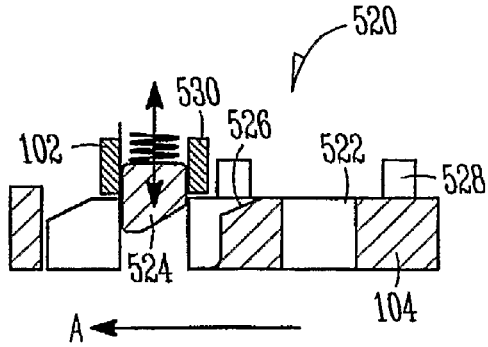
FIG. 17 shows a latching mechanism in accordance with one embodiment.

FIG. 17 shows a cross-section side view of a latching mechanism 520 for removably mounting base 104 to gaming device 102. In this example, base 104 includes a cavity 522 and device 102 includes a spring-loaded latch 524. As base 104 is slid in direction A, a front edge 526 of the sled pushes latch 524 out of the way and the base advances until the latch is forced by the spring into cavity 522. A projection 528 on base 104 also stops against a stop member 530 on the gaming device. A handle can be attached to the latch 524 to allow a user to retract the latch from cavity 522 and remove the base 104 from the device 102.

Figure 18:
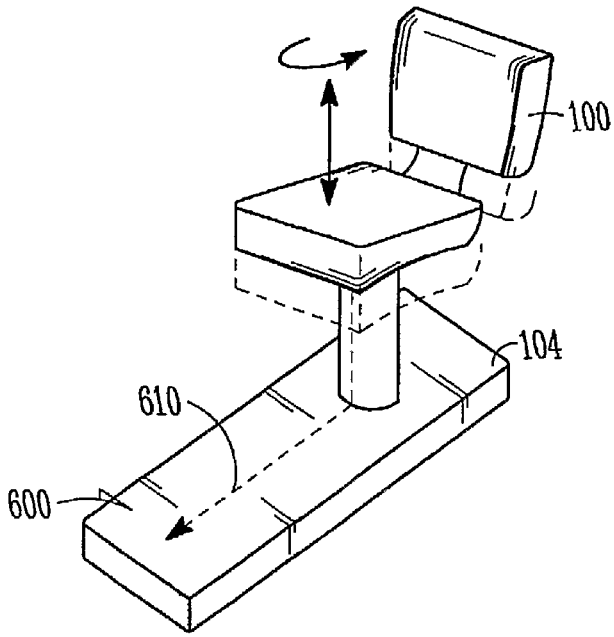
FIG. 18 schematically shows a latching mechanism according to one embodiment.

FIG. 18 schematically shows a latching mechanism 600 according to one embodiment. Latching mechanism 600 includes an actuating member 610 extending from chair 100 through base 104. The actuating member 610 can be a cord or bar or other member which translates along the length of the base to unlatch a latch member, such as discussed above. In this example, member 610 is operatively coupled to chair 100. Chair 100 is lifted and then twisted to cause member 620 to translate through base 104, unlatching the latching mechanism between base 104 and the gaming device. For example, cord 610 can be attached to handle 506 of lever 504 (FIG. 16) when the lever is mounted to base 104.

Again, this hidden and non-obvious technique allows for unlatching the base 104 to be a non-obvious process to the casual observer to prevent unauthorized access.

Referring again to FIG. 1, to electrically and mechanically connect the chair to the device, the base is slid towards the device and guided by the guiding pins and sockets, or other means, as discussed above. The base is then latched to the device using one of the techniques described above or another latching system. Then the electrical connection is made from the connector on the base to the connector on the machine.

The latch mechanisms as described above provide a secure retention technique of the base and connector, while providing a stress-free electrical connection. This is important if somebody lifts the chair for example. In other words, the mechanical coupling holds the units together tightly enough that twisting one or the other does not effect the electrical connection. Moreover, the non-obvious tool-less opening techniques make for easy, yet safe coupling and uncoupling while preventing unauthorized access.

To remove the base, for example, for maintenance reasons, the electrical connection is first decoupled, then the sled is unlatched and the base is slid away from the device.

In some embodiments, the system also allows for easy maintenance of the system. For example, to service the chair, a user decouples the chair as mentioned above, performs any service to the speakers or circuit board, or connectors, and then electrically and mechanically couples the chair back to the device.

Figure 19:
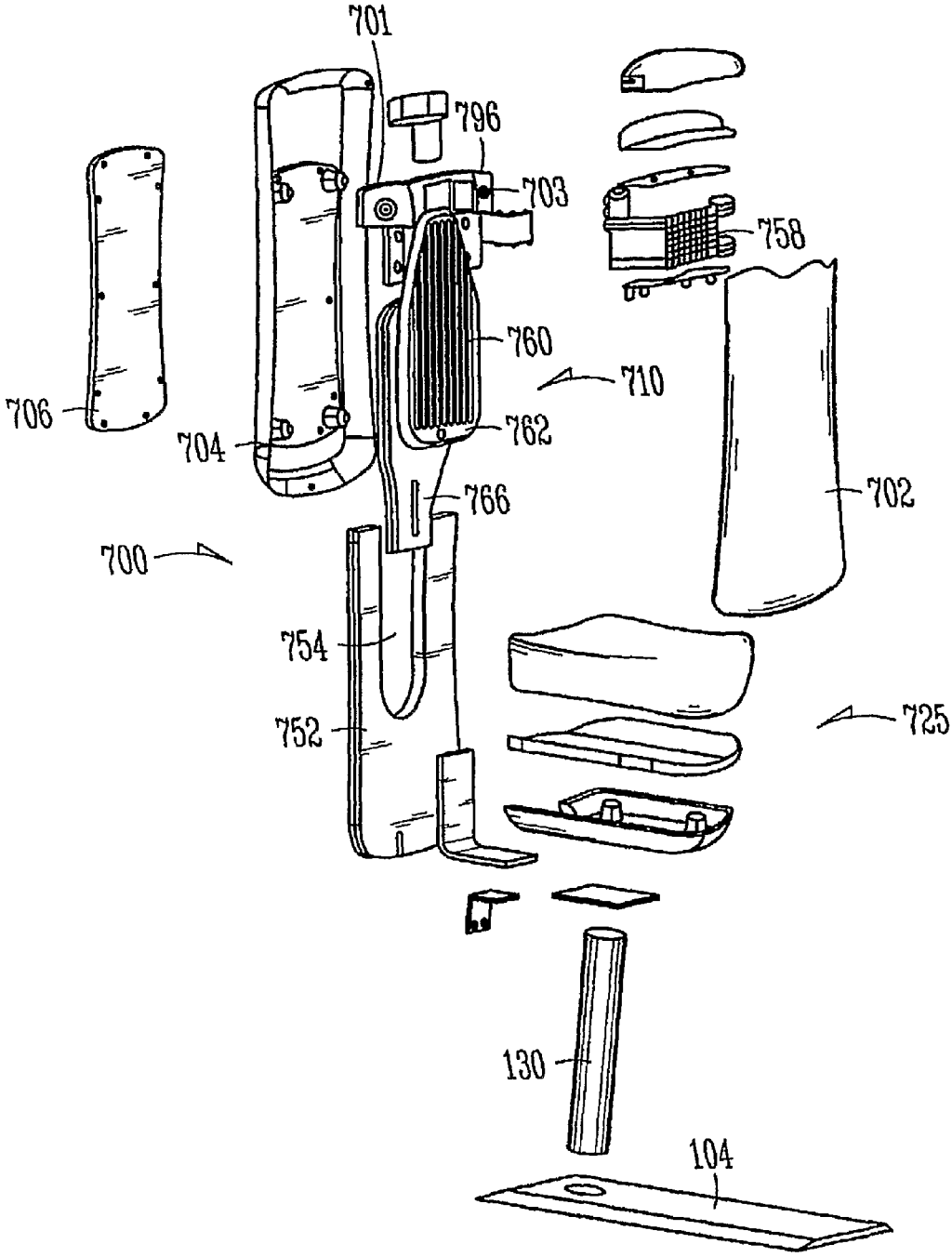
FIG. 19 shows an exploded view of a chair incorporating a speaker package, in accordance with one embodiment.

FIG. 19 shows an exploded view of a chair 700 incorporating a speaker package 710, in accordance with one embodiment. Chair 700 can include any features of other systems discussed above and certain details will be omitted for sake of clarity. For example, chair 700 can be coupled to a base 140 via a seat post 130 and an electrical connection (not shown) between the speaker package 710 and a gaming machine can be as discussed above.

Chair 700 generally includes a seat 725 and a seat back including a front seat back 702 and a back seat back 704, including an access panel 706. The seat backs 702 and 704 couple together to surround speaker package 710.

In one embodiment, speaker package 710 can include one or more upper speakers 701, 703, for example. Speaker package 710 also includes a shell assembly 760. A chair back mount 752 includes a U-shaped cut-out 754 to receive speaker assembly 710.

Figure 20:
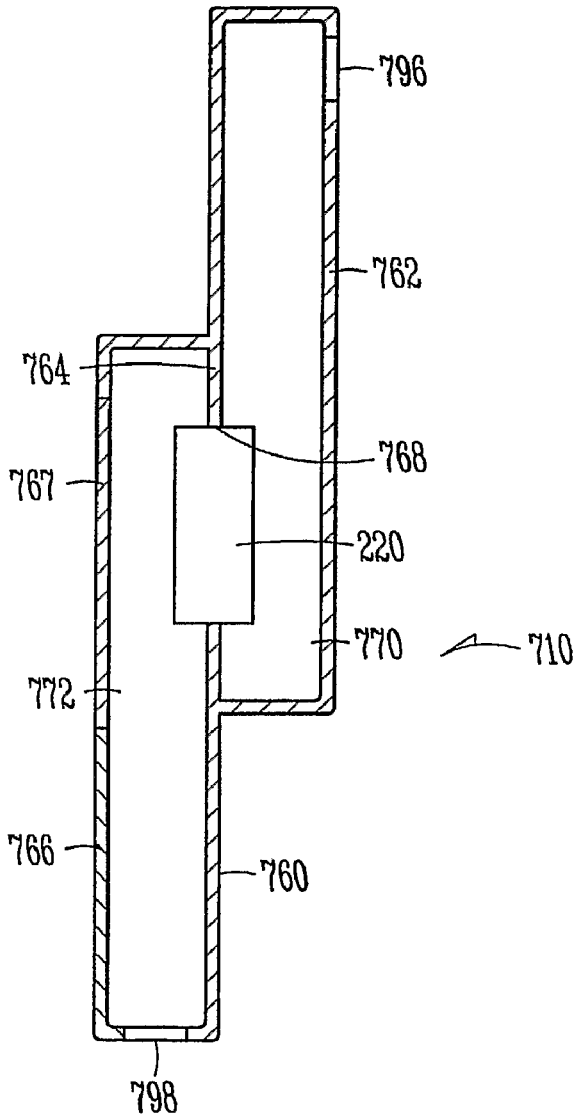
FIG. 20 shows a cross-section side view of a portion of the speaker package of FIG. 19.

Referring also now to FIG. 20 which shows a cross-section side view of a portion of speaker assembly 710, shell assembly 760 includes a front shell or member 762, a central member 764 and a back shell or member 766. In this example, front shell 762, central member 764, and back shell 766 are an integral unit, molded from a plastic, for example. Central member 764 is a generally planar member and includes a mounting area, such as a hole 768 for mounting a speaker 220 to the central member.

Back member 766 is a substantially similar structure and shape relative to front member 762. Back member 766 and front member 762 are substantially mirror images of each other. The front member and back members 762, 766 are oriented in opposite manner to central member 764. In other words, they are oriented upside down relative to each other. The front and rear spaces or cavities, 770 and 772, respectively, defined by the front and back members and central member 764 are substantially similar in size. This optimizes the performance of the speaker 220 mounted between the spaces.

Front member 762 includes a port 796 in an upper portion of the front member, for example. Port 796 allows air and sound to pass through to the person seated in the chair. A speaker grille 758 can be located over port 796. Back member 766 includes a port 798. Port 798 corresponds to port 796 and equalizes the air pressure of each side of the speaker assembly. Port 798 can be located in a lower surface of the back member or in other locations. Back member 766 can include an access panel 767 to mount and service speaker 220.

Thus, in one embodiment, speaker package 710 is a discrete unit, which can be pre-assembled and pre-tested before mounting to the chair mount. This allows the speaker package to be optimized for sound performance instead of just being retrofit into a typical chair. Again, this discrete speaker packaging system allows for improved sound from the speaker assembly since the speaker is properly mounted to central member 764 between the pair of front and back shells 762, 766 and thus defining similarly sized air spaces and is mounted in a manner such as to fill a part of the chair itself. Thus, speaker package 710 is integrated into the actual structure of the chair and not merely an add-on feature.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A speaker system comprising:

a chair having an electrical connection configured to electrically connect the chair to a gaming device;

a shell assembly comprising, a first shell that at least partially defines a first cavity, the first cavity in communication with a first port, a second shell that at least partially defines a second cavity distinct from the first cavity, the second cavity in communication with a second port, and a central member that extends between and separates the first cavity and the second cavity, wherein a first perimeter of the first cavity and a perimeter of the second cavity are in offset relation to one another; and a speaker package incorporated into the chair and coupled to the electrical connection, the speaker package including a speaker mounted to said central member and directed to emit sound waves into the first cavity.

2. The system of claim 1, wherein the speaker package, including the speaker mounted to the central member extending between and separating the first cavity and the second cavity, is mounted to a back of the chair.

3. The system of claim 1, wherein the speaker package includes at least three speakers, a first speaker is positioned about midway up a back of the chair and a second and a third speaker are positioned on an upper shoulder of the back of the chair.

4. The system of claim 1, wherein the chair is removably connectable to the gaming device.

5. The system of claim 4, wherein the chair includes a base, and the base is mechanically and electrically connectable to the gaming device.

6. The system of claim 1, wherein the first shell and the second shell are mounted to opposing sides of the central member and are positioned upside down relative to each other such that the first cavity and the second cavity are not completely overlap.

7. The system of claim 2, wherein the central member includes a generally planar member having a hole for mounting the speaker, the generally planar member longitudinally extending in a direction substantially parallel with the back of the chair and partially defining the first and second cavities.

8. The system of claim 1, wherein the central member, the first shell, and the second shell are integral to each other.

9. The system of claim 1, wherein the speaker package includes a second speaker and a third speaker mounted on an upper surface of the first shell, and wherein the first shell includes an upper extending section having a port located approximately between the second speaker and the third speaker near a symmetrical center line of the chair and spaced from all speakers, the port having a size and shape configured to allow air and sound to pass through to a person seated in the chair.

10. The system of claim 9, wherein the chair includes a chair back mounted over a portion of the speaker package, the chair back comprising a grill cap mounted over the second speaker, the third speaker, and the port.

11. The system of claim 10, wherein the grill cap is attached to a front part of the chair back.

12. The system of claim 10, wherein the grill cap is integral to a back part of the chair back.

13. The system of claim 1, wherein the chair includes a back mounting frame including a U-shaped cut-out, and wherein the speaker package includes a corresponding U-shaped outer surface such that a portion of the speaker package fits within the U-shaped cut-out.

14. The system of claim 13, wherein the speaker package is mounted to the back mounting frame such that the first shell is on one side of the frame and the second shell is on a second side of the frame.

15. The system of claim 1, wherein the chair includes a removable or hinged back configured to provide access to the speaker package.

16. A speaker system comprising:

a chair having an electrical connection configured to electrically connect the chair to a gaming device;

a shell assembly comprising, a first shell that at least partially defines a first cavity, the first cavity in communication with a first port, a second shell that at least partially defines a second cavity having a similar size as the first cavity, the second cavity in communication with a second port, and a central member that extends between and separates the first cavity and the second cavity, wherein a first perimeter of the first cavity and a perimeter of the second cavity are in offset relation to one another; and a discrete speaker package mounted to a back frame of the chair and filling at least a portion of a chair back, the speaker package including a speaker mounted to the central member and directed to emit sound waves into the first cavity.

17. The system of claim 16, wherein the first shell and the second shell are mounted to opposing side of the central member, in a non-aligning manner, and are positioned upside down relative to each other.

18. The system of claim 17, wherein the central member includes a generally planar member having a hole for mounting the speaker, the generally planar member longitudinally extending in a direction substantially parallel with the chair back and partially defining the first and second cavities.

19. The system of claim 17, wherein the central member, the first shell, and the second shell are integral to each other.

20. The system of claim 16, wherein the speaker package includes a second speaker and a third speaker mounted on an upper surface of the first shell, and wherein the first shell includes an upper extending section having a port located approximately between the second speaker and the third speaker and spaced from all speakers, the port having a size and shape configured to allow air and sound to pass through to a person seated in the chair.

21. The system of claim 20, wherein the chair back is mounted over a portion of the speaker package, the chair back comprising a grill cap mounted over the second speaker, the third speaker, and the port.

22. The system of claim 16, wherein the back frame of the chair includes a U-shaped cut-out, and wherein the speaker package includes a corresponding U-shaped outer surface such that a portion of the speaker package fits within the U-shaped cut-out.

23. The system of claim 22, wherein the speaker package is mounted such that the first shell is on one side of the back frame and the second shell is on a second side of the back frame.

24. A speaker system comprising:

a chair having an electrical connection configured to electrically connect the chair to a gaming device;

a shell assembly including a first shell, a central member, and a second shell, the first shell and the second shell mounted in an opposite manner to the central member such that a perimeter of the first shell is offset relative to a perimeter of the second shell; and a speaker package incorporated into a back of the chair and coupled to the electrical connection, the speaker package including a speaker mounted to the central member disposed between and separating the first shell defining a first cavity and the second shell defining a second cavity, wherein the first cavity and the second cavity are discrete cavities, each providing an air space in communication with a port.

* * * * *